United States Patent [19]

Rolen

[11] Patent Number: 4,615,063

[45] Date of Patent: Oct. 7, 1986

[54] BOX GIRDER AND SUSPENSION ASSEMBLY

[76] Inventor: Carl R. Rolen, Box A54, Pataskala, Ohio 43062

[21] Appl. No.: 670,934

[22] Filed: Nov. 13, 1984

[51] Int. Cl.[4] ..... E01D 11/00

[52] U.S. Cl. ..... 14/18; 14/14; 14/17; 52/731; 182/150

[58] Field of Search ..... 14/1, 13, 14, 17, 18, 14/20, 22, 23, 69.5, 73, 71.1; 403/408; 248/235, 317, 328, 568, 581; 182/150, 142, 196; 52/731; 254/29 A; 404/41

[56] References Cited

U.S. PATENT DOCUMENTS

| | | | |
|---|---|---|---|
| 424,154 | 3/1890 | Wildin et al. | 14/22 |
| 1,616,480 | 2/1927 | Zimmerman | 14/73 |
| 2,478,993 | 8/1949 | Wing | 404/41 X |
| 3,043,109 | 7/1962 | Erickson | 14/1 X |
| 3,056,266 | 10/1962 | Van Wyk | 52/731 |
| 3,682,440 | 8/1972 | Walker | 254/29 A |

*Primary Examiner*—James A. Leppink
*Assistant Examiner*—Matthew Smith
*Attorney, Agent, or Firm*—Rambo & Rambo

[57] ABSTRACT

An anchoring rod extends vertically through a hollow box girder underlying a suspension bridge or suspended walkway. The anchoring rod is connected at its upper end to a suspension cable and is provided at its lower end with a stop member which can be tightened against the lower wall of the girder. The opening in the lower wall of the girder through which the anchoring rod extends is larger than the opening in the upper wall of the girder, and a tubular, load-bearing sleeve is carried on the anchoring rod through the lower wall opening. The tubular sleeve is sized so that the upper end abuts against the inner surface of the upper wall of the girder and the lower end abuts against the stop member when the stop member is tightened against the lower wall of the girder.

2 Claims, 3 Drawing Figures

BOX GIRDER AND SUSPENSION ASSEMBLY

BACKGROUND OF THE INVENTION

The present invention relates to support structures for suspended walkways, suspension bridges and the like, and more particularly to a novel girder or beam construction and to a novel means of attaching an anchoring rod or hanger to the girder.

In the past, the primary box girders that underpinned suspension bridges and walkways were linked to the suspension cables which supported them by means of hangers or anchoring rods. Typically, the girders had a hollow, generally rectangular cross-sectional configuration, and the anchoring rod extended vertically therethrough. The head of the anchoring rod projected above the upper wall of the girder and was adapted to engage a cooperative connector on the suspension cable. The opposite end or tail of the anchoring rod projected below the lower wall of the girder. A stop member or members carried on the tail of the anchoring rod engaged the lower wall of the girder and carried a great deal of the load.

A major drawback to the above-described suspension assembly was the concentration of structural and applied loads on the lower wall of the girder. It was here that the support provided by a suspension cable, via the anchoring rod, was exerted on the girder. The primary site of attachment or contact for the stop member on the anchoring rod was the lower wall of the girder. Thus, if the stress in this area was sufficiently increased by overloading, material defects, degeneration or resonant vibrations, the girder could collapse inwardly from the lower wall towards the upper wall. While some of the compressive force exerted on the lower wall was diffused by the side walls of the girder, the real possibility of disaster compelled the present inventor to search for ways to distribute the load more evenly.

The present invention distributes the load on the girder more evenly by providing an additional area of contact between the girder and a stop member carried on the anchoring rod. Heretofore, the anchoring rod passed through the upper wall of the girder without being connected or secured thereto. In the present invention, as explained below, the hanger or anchoring rod is provided with a sleeve that engages the stop member at one end and the upper wall of the girder at its opposite end. Thus, the load resistance provided by the suspension cable is transmitted directly to both the upper and lower walls of the girder.

SUMMARY AND OBJECTS OF THE INVENTION

The present invention is a combined box girder and suspension assembly that basically comprises an elongated hollow girder having relatively opposing upper and lower walls; a generally vertically arranged suspension member, such as an anchoring rod, extending through the girder and having relatively opposing portions projecting, respectively, above and below the upper and lower walls of the girder; a stop element carried on the suspension member beneath the lower wall of the girder; and a load-distributing device carried on the suspension member and extending upwardly from the stop element. The upper and lower walls of the girder are formed, respectively, with at least one upper wall opening at least one lower wall opening, the lower wall opening being generally vertically aligned with and larger than the upper wall opening. The suspension member extends through the upper and lower wall openings of the girder. The stop element carried on the suspension member is sized to span the lower wall opening, and the load-distributing device carried on the suspension member is sized for passage through the lower wall opening and for engagement at opposite ends thereof with the stop member and the upper wall of the girder simultaneously with the stop member engaging the lower wall of the girder.

A primary object of the present invention is to provide a stronger and more durable girder and suspension assembly than has heretofore been constructed. Another object of the present invention is to provide a means of reinforcing and reconditioning girder and suspension assemblies on existing bridges and walkways. A further object of the present invention is to provide a girder and suspension assembly that is highly adaptable to a variety of traffic bearing structures that are supported by means other than, or in addition to, load-bearing members extending downwardly from the structure to a foundation. Further objects and advantages of the present invention may become more readily apparent in light of the drawings and description of the preferred embodiment set forth below.

DETAILED DESCRIPTION OF THE PREFERRED EMBODIMENT

Figure 1:
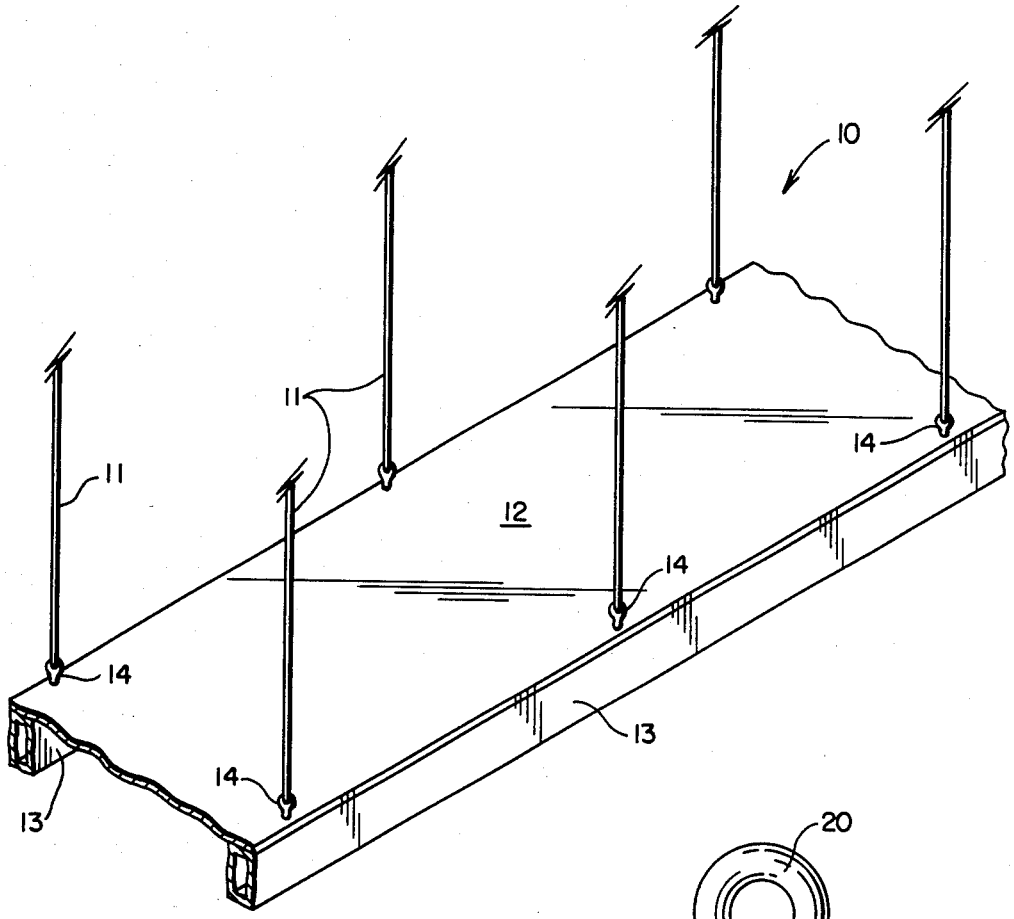
FIG. 1 is a perspective view of a portion of a suspended structure, such as a bridge or walkway, that is provided with a girder and suspension assembly according to the present invention.

As indicated in FIG. 1, a suspension bridge or suspended walkway, generally designated 10, is typically supported, at least in part, by a series of steel cables or struts 11 disposed at spaced, regular intervals along opposite sides of a traffic-bearing platform 12. The suspension cables 11 are fastened at their upper ends to the primary suspension or truss components (not shown). At their lower ends, the steel cables or struts 11 are secured to a number of box girders 13 by means of a plurality of suspension members or anchoring rods 14. In this manner, the support provided by the primary suspension or truss components is transmitted to the traffic-bearing portion of the bridge. Typically, the box girders 13 are longitudinally coextensive with and are disposed in underlying relation to the opposite lateral sides of the traffic-bearing surface 12. Cross joists (not shown) or other intermediate support members typically extend between the laterally spaced apart girders 13 in a manner well known to those skilled in the art.

Figure 3:
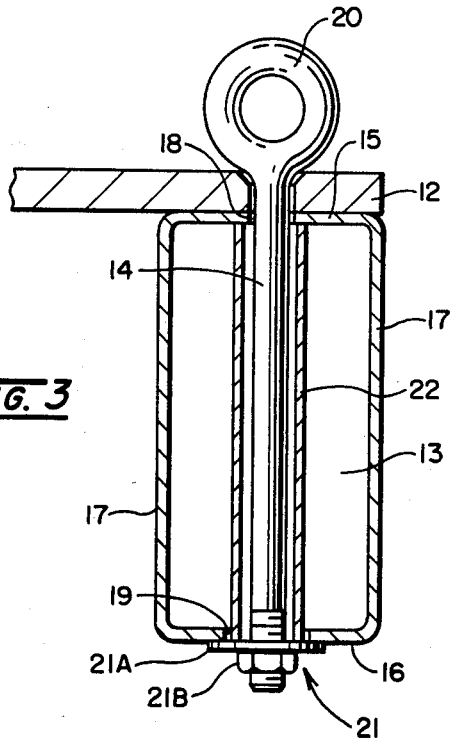
FIG. 3 is a further enlarged and detailed vertical sectional view of a preferred form of the present invention.
Figure 2:
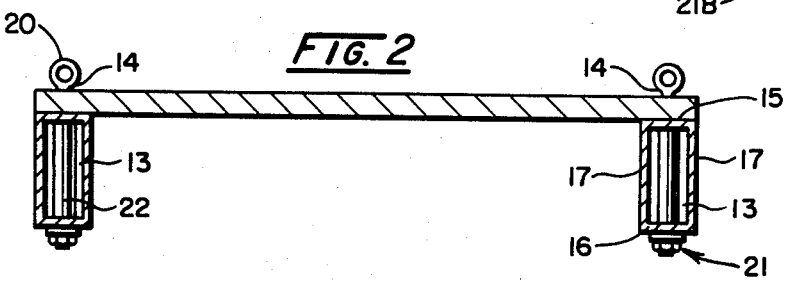
FIG. 2 is an enlarged vertical sectional view of a portion of the suspended structure depicted in FIG. 1 and illustrates particularly a preferred manner in which the various elements of the present girder and suspension assembly are disposed relative to the platform portion of the bridge or walkway.

As best indicated in FIGS. 2 and 3, each of the box girders 13 is a hollow or tubular structure formed with an upper wall 15, a lower wall 16 and a pair of laterally spaced apart, longitudinally coextensive side walls 17. Preferably, each girder is constructed in the usual manner with steel plate material and/or angle iron to form a rectangular cross-section. The upper and lower walls 15 ad 16 of the girder are provided, respectively, with a plurality of longitudinally spaced apart upper wall openings 18 and lower wall openings 19, the lower wall openings 19 being generally vertically aligned with and larger than the upper wall openings 18. Both the upper and lower wall openings 18 and 19 are large enough to permit substantial portions of the anchoring rods 14 to pass therethrough.

The anchoring rod 14 is formed with an elongated, axially extending shaft that passes through the upper and lower wall openings 18 and 19 of the girder 13 and that is sufficiently long to permit relatively opposing end portions of the anchoring rod to extend, respectively, above the upper wall 15 and below the lower wall 16. The upper end portion of the anchoring rod 14 is formed into a connector terminal, such as an eye 20 or other configuration suitable for engaging a cooperative connector (not shown) on the suspension cable 11. Advantageously, by providing an enlargement on the upper end portion, a limit to the downward movement of the anchoring pin is established. The lower end portion of the anchoring rod 14 projecting below the lower wall 16 is provided with means for engaging a stop member, generally designated 21, such as threading, as illustrated, or other modifications that permit the stop member 21 to be secured thereto. Thus, the anchoring rod 14 may exist, advantageously in the form of an eye bolt, as illustrated in FIGS. 2 and 3, although it is equally possible for the terminal portions of the anchoring rod 14 to have substantially different configurations from those illustrated. Preferably, the anchoring rod 14 is cast from high tensile strength steel alloy material, as it is subjected to tremendous axially oriented forces tending to pull it in opposite directions away from its center.

In addition to being adapted to engage the lower end of the anchoring rod 14, the stop member 21 must be large enough to span the lower wall opening 19. Preferably, the stop member 21 comprises a washer 21A and a nut 21B. The washer 21A is large enough in diameter to extend well beyond the lower wall opening 19, as illustrated in FIG. 3, and the nut 21B tightens the washer 21B against the lower wall 16 of the girder and locks said washer 21B in place. One skilled in the art would, in all probability, be able to substitute a different sort of stop or locking member for the above-described washer and nut assembly. For instance, it might be possible to bore a hole in the lower end of the anchoring rod and insert a locking pin into the bore, instead of using a nut to hold the wahser 21A in place. Preferably, however, the stop member 21 is adapted to be tightened onto the lower end of the anchoring rod 14, so that any play or spaces between the various components may be eliminated. In addition, the cooperative fastening portions of the stop member 21 and on the lower end of the anchoring rod 14 must be able to withstand the downwardly directed shear forces which the load imposes upon the stop member 21 via the box girder 13.

As best indicated in FIG. 3, a tubular, compression load-bearing sleeve 22 is carried on the shaft of the anchoring rod 14 within the box girder 13. The sleeve 22, like the shaft of the anchoring rod 14, is axially elongated, and has a generally uniform outer diameter somewhat greater than the diameter of said shaft. In addition, the outer diameter and, preferably, the inner diameter of the sleeve 22 are greater than the diameter of the upper wall opening 18 and are less than the diameter of the lower wall opening 19. Furthermore, the sleeve 22 is approximately equal in length to the distance between the inner surface of the girder's upper wall 15 and the outer surface of the lower wall 16. Due to the substantial compressive forces applied to the sleeve when the suspension assembly is subjected to a load, the sleeve 22 is preferably formed from tempered steel or other material that will prevent the sleeve 22 from collapsing.

Since the outer diameter of the sleeve 22 is less than the diameter of the lower wall opening 19 and greater than the diameter of the upper wall opening 18, said sleeve 22 can be inserted into the girder 13 through the lower wall opening 19, yet cannot escape through the upper wall opening 18. Once inserted, the upper end of the sleeve 24 abuts against the inner surface of the upper wall 15 of the girder surrounding the upper wall opening 18, and the lower end of the sleeve 24 is disposed in the lower wall opening 19 substantially even with or slightly below the outer surface of the lower wall 13. The anchoring rod 14 can then be inserted downwardly through the girder 13 and the sleeve 24, and the washer 21A and the nut 21B can be positioned on the lower end of the anchoring rod 14 projecting below the lower wall 16 of the girder. The nut 21B is then tightened onto the lower end of the anchoring rod 14 until the washer 21A presses tightly against the outer surface of the girder's lower wall 16. The washer 21A can be drawn up against the lower wall 16 in part because the upper terminal portion of the anchoring rod 14 is enlarged. This enlargement provides a limit to the downward movement of the anchoring rod at the point where the upper terminal portion of the anchoring rod 14 abuts against the traffic-bearing platform 12 or other structure (not shown) surmounting the traffic bearing platform 12 and through which the shaft of the anchoring rod 14 passes.

By drawing the washer 21A up against the girder's lower wall 16, the upper end of the sleeve 24 is simultaneously drawn tightly up against the inner surface of the girder's upper wall 15. This is accomplished because, as the washer 21A draws close to or begins to engage the lower wall 16 of the girder, it also abuts against the sleeve's lower end and elevates the entire sleeve 22. Since the sleeve 22 is approximately equal in length to the distance between the inner surface of the girder's upper wall 15 and the outer surface of the girder's lower wall 16, the upper end of the sleeve 22 is drawn tightly against the inner surface of the girder's upper wall 15 simultaneously with the washer 21A being drawn tightly against the outer surface of the girder's lower wall 16 and the lower end of the sleeve 22. Thus, by tightening the nut 21B onto the threaded lower end of the anchoring rod 14, the girder 13 and the various elements of the present suspension assembly are drawn tightly together. The sleeve 22, however, absorbs most of the compressive forces on the girder which are exerted by this tightening action.

Once the present box girder and suspension assembly are installed and the bridge or walkway is placed under a load or overload condition, a substantial portion of the compressive force to which the girder's lower wall 16 is subjected will be transmitted to the upper wall 15 by means of the load-bearing sleeve 22. In effect, the lower wall 16 cannot collapse inwardly without, at the same time, deforming the sleeve 22 and/or the upper wall 15 of the girder 13. Accordingly, the strength of the connection between the suspension cables 11 and the box girders 13 is substantially increased over what had heretofore been a relatively weak link in the suspension assembly.

In addition to its use on new structures, the present box girder and suspension assembly is well suited for reinforcing the linkages between the suspension struts and box girders on old bridges and walkways. The first step in repairing each linkage is to detach the old anchoring rod from the suspension cable 11 and remove it from the box girder 13. Next, the opening in the lower wall of the girder is enlarged so that it can receive one of the above-described, tubular load-bearing sleeves 22. Advantageously, the sleeve 22 may be easily cut on site from tubular stock material so that its length is substantially equal to the distance between the inner surface of the old girder's upper wall 15 and the outer surface of its lower wall 16. The ease with which the length of the sleeves 22 may be varied from sleeve to sleeve is particularly advantageous in repairing old bridges and walkways where stress, overload conditions and material degeneration have created irregularities in the girders.

Once the lower wall opening 19 and the sleeve 22 are properly formed and sized, a new anchoring rod 14 is inserted through the old box girder 13. Preferably, the anchoring rods 14 are sufficiently long to accommodate any enlargements in the girder 13 which cannot be reduced, and are provided with threaded lower end portions which are sufficiently long to permit an end portion thereof to be removed if the space below the girder is insufficient to accommodate the entire end projection. Once the new anchoring rod 14 has been inserted into the girder from above, and the load-bearing sleeve 22 has been inserted from below through the enlarged lower wall opening, the washer 22 is inserted onto the threaded end of the anchoring rod 14 and the nut 23 is tightened thereon until the washer 22 has been sufficiently tightened against the outer surface of the lower wall 16. The old suspension cable 11 is then connected by suitable means well known in the art to the upper, terminal end of the new anchoring rod 14.

Thus, a box girder and suspension assembly according to the present invention not only provides a stronger connection than heretofore possible between the suspension cable and the girder underlying the traffic-bearing platform on new suspension bridges and suspended walkways, it also provides a means of repairing and reinforcing old bridges and walkways at the sites where the cables are connected to the girders.

While a single preferred embodiment of the present invention has been illustrated and described in some detail, the present disclosure is not intended to unduly limit or restrict either the invention or the scope of the following claims.

I claim:

1. A suspension assembly for a hollow box girder of the type having relatively opposing upper and lower walls formed with a pair of generally vertically aligned openings, said assembly comprising:

(a) an elongated anchoring rod extending axially through the openings formed in the upper and lower walls of said girder, said anchoring rod terminating in an upper connector terminal disposed above the upper wall of said girder and a lower, screw-threaded terminal disposed below the lower wall of said girder;

(b) stop means carried on the lower, screw-threaded terminal of said anchoring rod and in spanning relation to the opening formed in the lower wall of said girder; and (c) a load-distributing sleeve carried on said anchoring rod and having a lower end extending through the opening formed in the bottom wall of the girder and abutting against the stop means and having an upper end disposed in abutment with the upper wall of said girder.

2. A box girder and suspension assembly comprising, in combination:

(a) a hollow, elongated box girder having at least one pair of generally transversely aligned openings formed in relatively opposing, spaced apart wall portions thereof, one of said openings being larger than the other;

(b) a suspension member extending through and between the openings in the opposing wall portions of the girder and outwardly therefrom;

(c) a load-distributing sleeve carried on the suspension member generally within the girder, said sleeve being sized to pass through the larger opening and to span the smaller opening in the girder; and (d) stop means carried on the suspension member outwardly of and in spanning relation to the larger opening of the girder.

* * * * *